US011326750B2

(12) United States Patent
Jiang

(10) Patent No.: US 11,326,750 B2
(45) Date of Patent: May 10, 2022

(54) HIGH-TEMPERATURE DEFORMATION RESISTANT EFFECT DISK AND STAGE LIGHT INCLUDING SAME

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 17/241,611

(22) Filed: Apr. 27, 2021

(65) Prior Publication Data

US 2021/0247041 A1 Aug. 12, 2021

Related U.S. Application Data

(63) Continuation of application No. PCT/CN2020/082247, filed on Mar. 31, 2020.

(30) Foreign Application Priority Data

Jun. 26, 2019 (CN) ..... 201910566377.6
Jul. 31, 2019 (CN) ..... 201921224192.9

(51) Int. Cl.
*F21S 10/00* (2006.01)
*F21V 1/10* (2006.01)
*F21W 131/406* (2006.01)

(52) U.S. Cl.
CPC ..... *F21S 10/007* (2013.01); *F21V 1/10* (2013.01); *F21W 2131/406* (2013.01)

(58) Field of Classification Search
CPC ..... F21V 1/10; F21S 10/007; F21W 2131/406
(Continued)

(56) References Cited

U.S. PATENT DOCUMENTS 5,006,965 A * 4/1991 Jones ..... F21V 11/00 362/277
5,795,058 A 8/1998 Owen
(Continued)

FOREIGN PATENT DOCUMENTS

CN 103502865 A 1/2014
CN 110285379 A 9/2019
(Continued)

OTHER PUBLICATIONS

International Search Report for Application No. PCT/CN2020/082247, dated Jun. 30, 2020, 3 pages.

*Primary Examiner* — Laura K Tso
(74) *Attorney, Agent, or Firm* — Lerner, David, Littenberg, Krumholz & Mentlik, LLP

(57) ABSTRACT

The present invention discloses a high-temperature deformation resistant effect disk, including a disk body and a plurality of hollow holes provided on the disk body and used to generate light effects, in which an outer periphery of the disk body is provided with a plurality of notches, and/or an inner periphery of the disk body where a central pivot hole is formed is provided with a plurality of notches. The notches are provided on the outer periphery and/or the inner periphery of the disk body to absorb strain force generated by thermal expansion of effect regions used to provide the hollow holes on the disk body, so that the disk body can return to an original shape after cooling without generating deformation and affecting generated pattern shapes, and the effect disk also may not be in contact with other elements in a process of rotation or translation.

20 Claims, 10 Drawing Sheets

(58) Field of Classification Search
USPC ..... 362/311.13, 322
See application file for complete search history.

(56) References Cited

U.S. PATENT DOCUMENTS

| | | | | |
|---|---|---|---|---|
| 6,386,728 | B1 * | 5/2002 | Colonna | F21S 10/005 362/123 |
| 2003/0076681 | A1 | 4/2003 | Rasmussen et al. | |
| 2009/0097260 | A1 * | 4/2009 | Dielen | F21V 11/08 362/317 |
| 2013/0094219 | A1 * | 4/2013 | Jurik | F21V 14/00 362/322 |

FOREIGN PATENT DOCUMENTS

| | | | | |
|---|---|---|---|---|
| CN | 210319805 U | | 4/2020 | |
| GB | 2195012 A | * | 3/1988 | F21V 17/16 |

* cited by examiner

HIGH-TEMPERATURE DEFORMATION RESISTANT EFFECT DISK AND STAGE LIGHT INCLUDING SAME

CROSS REFERENCE TO RELATED APPLICATIONS

The present application is a continuation of International Application No. PCT/CN2020/082247, filed on Mar. 31, 2020, which claims priorities from Chinese Patent Application No. 201910566377.6 filed on Jun. 26, 2019, and Chinese patent Application No. 201921224192.9 filed on Jul. 31, 2019, all of which are hereby incorporated herein by reference.

TECHNICAL FIELD

The present invention relates to the technical field of lighting devices, and more specifically, to a high-temperature deformation resistant effect disk and a stage light including the same.

BACKGROUND

The effect disk is one type of pattern sheets often used in stage lights, and is generally composed of metal material. Effect regions on the effect disk are provided with transparent or hollow patterns. A light path can project patterns, such as flames, white clouds, flowing water and starry sky, after passing through the effect regions. As shown in FIG. 1, an existing effect disk includes a ring-shaped disk body 1, in which the disk body 1 is provided with a plurality of hollow holes 2 and has a central pivot hole in the center, and a continuous and uninterrupted annular area 9 is generally provided on an inner periphery 7 and an outer periphery 8 of the disk body 1. However, due to the fact that the power of a light source of a stage light is usually quite high and the effect disk tends to absorb partial heat of the light, the effect area will be heated and expanded. The deformation of the effect regions caused by thermal expansion is suppressed under the limitation of the annular area 9, which results in irreversible deformation of the effect regions, affects the generated pattern shapes, or the deformation of the effect regions caused by thermal expansion may break the annular area 9 and cause the deformation of the effect disk. An optical system of a stage light has a constant focal point, only fine adjustment can be performed, while general stage lights have a plurality of effect disks distributed on or near the focal point to ensure that projected patterns are clear, so that mounting distances among the effect disks are quite small, and the deformation of the effect disk may cause that the effect disk is in contact with other elements in a process of rotation or translation.

SUMMARY

The present invention provides a high-temperature deformation resistant effect disk and a stage light including the same, which can effectively prevent high-temperature deformation of the effect disk and avoid heat-induced irreversible deformation that causes damage to the effect disk.

According to the present invention, the high-temperature deformation resistant effect disk includes a disk body and a plurality of hollow holes provided on the disk body and used to generate light effects, in which an outer periphery of the disk body is provided with a plurality of notches, and/or an inner periphery of the disk body where a central pivot hole is formed is provided with a plurality of notches.

According to such configuration, compared with the existing effect disks, notches are provided on the outer periphery and/or inner periphery of the disk body to absorb strain force generated by thermal expansion of effect regions used to provide the hollow holes on the disk body, so that the disk body can return to an original shape after cooling without generating deformation and affecting generated pattern shapes, and the effect disk also may not be in contact with other elements in a process of rotation or translation.

According to the present invention, in an area defined by the notches and the hollow holes of the disk body at one end away from each other, an annular ring similar to an outline of the outer periphery is formed by taking a center of the disk body as a center, and the annular ring is a discontinuous ring. Therefore, all the stress in the area defined by the notches and the hollow holes at one end away from each other can be fully released, and the deformation of the disk body caused by the fact that the heat-induced stress cannot be released is avoided.

According to the present invention, the disk body can be circular or rectangular. A circular shape is the most commonly used shape of the effect disk. Generally, when the effect disk is circular, the effect disk realizes dynamic pattern effects in the form of rotation; a rectangular effect disk is not commonly used since this usually realizes dynamic pattern effects in a moving manner during use, which requires larger spatial locations. Regardless of whether the disk body is circular or rectangular, the notches provided thereon can release the strain force of the disk body after being heated. The same effect can be achieved when the disk body is in other shapes. A circular or rectangular shape is only a preferred embodiment in this application.

According to the present invention, with the center of the disk body as a center, both the hollow holes and the notches are provided radially in a radial direction or in a circumferential direction of the disk body. The extending direction of the notches is consistent with that of the hollow holes, which can produce light effects together with richer effects.

According to the present invention, the notches on the outer periphery are at least partially provided at equal intervals, and/or the notches on the inner periphery are at least partially provided at equal intervals, so that the strain force of the disk body is evenly released as much as possible in order to prevent warp caused by excessive absorption of local strain force.

According to the present invention, when the plurality of notches are provided on the outer periphery of the disk body, a central angle between any adjacent notches is ≤15° with the center of the disk body taken as the center. This ensures that the strain force at each position of the disk body close to the outer periphery can be fully released, and prevents positions between adjacent notches corresponding to an excessively large central angle of the outer periphery on the disk body from being heated and deformed, thereby ensuring a heat and deformation resistant performance of the entire disk body.

According to the present invention, when the inner periphery of the disk body used to form the central pivot hole is provided with a plurality of notches, a central angle between any adjacent notches is ≤45° with the center of the disk body taken as the center. The circumference of the inner periphery is small, so that a corresponding central angle between adjacent notches can be appropriately enlarged. However, it should be ensured that a central angle between any adjacent notches is ≤45°, and thus the strain force between adjacent notches can be sufficiently released.

According to the present invention, a communication relationship between a notch and a hollow hole is divided into two solutions.

In a first solution, the notch does not communicate with the hollow hole. Further, when the notch does not communicate with the hollow hole, the notch extends into an area between two adjacent hollow holes. With this arrangement, distribution of the notch and the hollow hole is more reasonable, and the heat and deformation resistant performance of the effect disk is further improved.

In a second solution, the notch communicates with the hollow hole. Further, the notch extends into an area between two adjacent hollow holes and communicates with at least one of the hollow holes; or the notch does not extend into between two adjacent hollow holes, but directly communicates with an end of the hollow holes.

According to the present invention, a width of a notch gradually decreases or remains constant in a direction close to the center of the disk body, which is because the closer the disk body is to the center, the smaller the area is. With this design, the design of the width of the notch is more reasonable and looks more aesthetically pleasing.

According to the present invention, one surface of the disk body is a black surface or a frosted surface, and the other corresponding surface is a polished surface. The black surface can be formed by paint spraying, and the frosted surface can be formed by roughening. During actual use, the surface which is the black or frosted surface of the disk body is provided far away from a light source so as to avoid that a reflected ray causes an emergent ray to be mixed with parasitic light; the polished surface of the disk body is provided directly facing the light source, and the polished surface can prevent the effect disk from absorbing heat.

The present invention also provides a stage light including a light source used to generate a light path and any of the above-mentioned effect disks, in which the light source and the effect disk are both located in a light head.

In the area defined by the notches and the hollow holes of the disk body at one end away from each other, an annular ring similar to an outline of the outer periphery is formed by taking a center of the disk body as a center of the annular ring, and the annular ring is a discontinuous ring.

The stage light also includes a rotation driving mechanism used to drive the effect disk to rotate and/or a movement driving mechanism used to drive the effect disk to move, both of which are not required at the same time as long as one of the both is provided. The movement driving mechanism drives the effect disk to cut in and out of the light path, so as to determine whether the light path is affected. A manner in which the movement driving mechanism drives the effect disk to cut in and out of the light path can be translation or swing, that is, revolution.

DETAILED DESCRIPTION OF EMBODIMENTS

Figure 1:
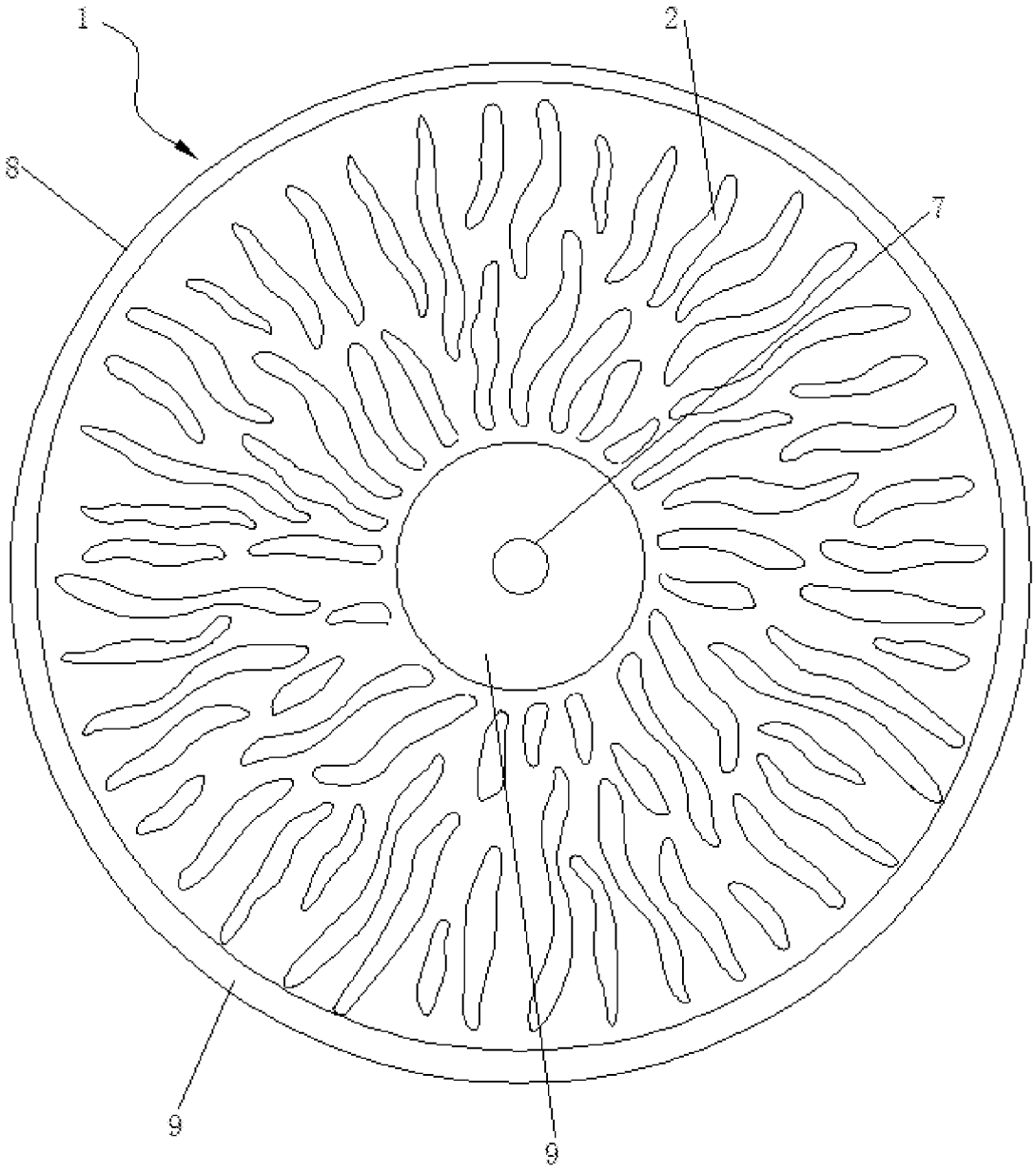
FIG. 1 is a schematic structural view of an effect disk according to a prior art.

The drawings are for illustration purpose only and are not intended to limit the present invention. Some components in the drawings may be omitted, enlarged or reduced for better illustrating the embodiments, so that sizes of these components do not represent that of actual products. For those skilled in the art, it will be understood that some known structures in the drawings and descriptions thereof may be omitted. The positional relationships described in the drawings are for illustration purpose only and are not intended to limit the present invention.

According to the present invention, a high-temperature deformation resistant effect disk is provided, including a disk body 1 and a plurality of hollow holes 2 provided on the disk body 1 which is used to generate light effects, in which an outer periphery 8 of the disk body 1 is provided with a plurality of notches 3, and/or an inner periphery 7 of the disk body 1 where a central pivot hole 5 is formed is provided with a plurality of notches 3.

The present invention solves the problem of high-temperature deformation of the effect disk by providing the notches 3 on the disk body 1 to release strain force after thermal expansion. The position arrangement of the notches 3 includes several situations as follows.

Figure 2:
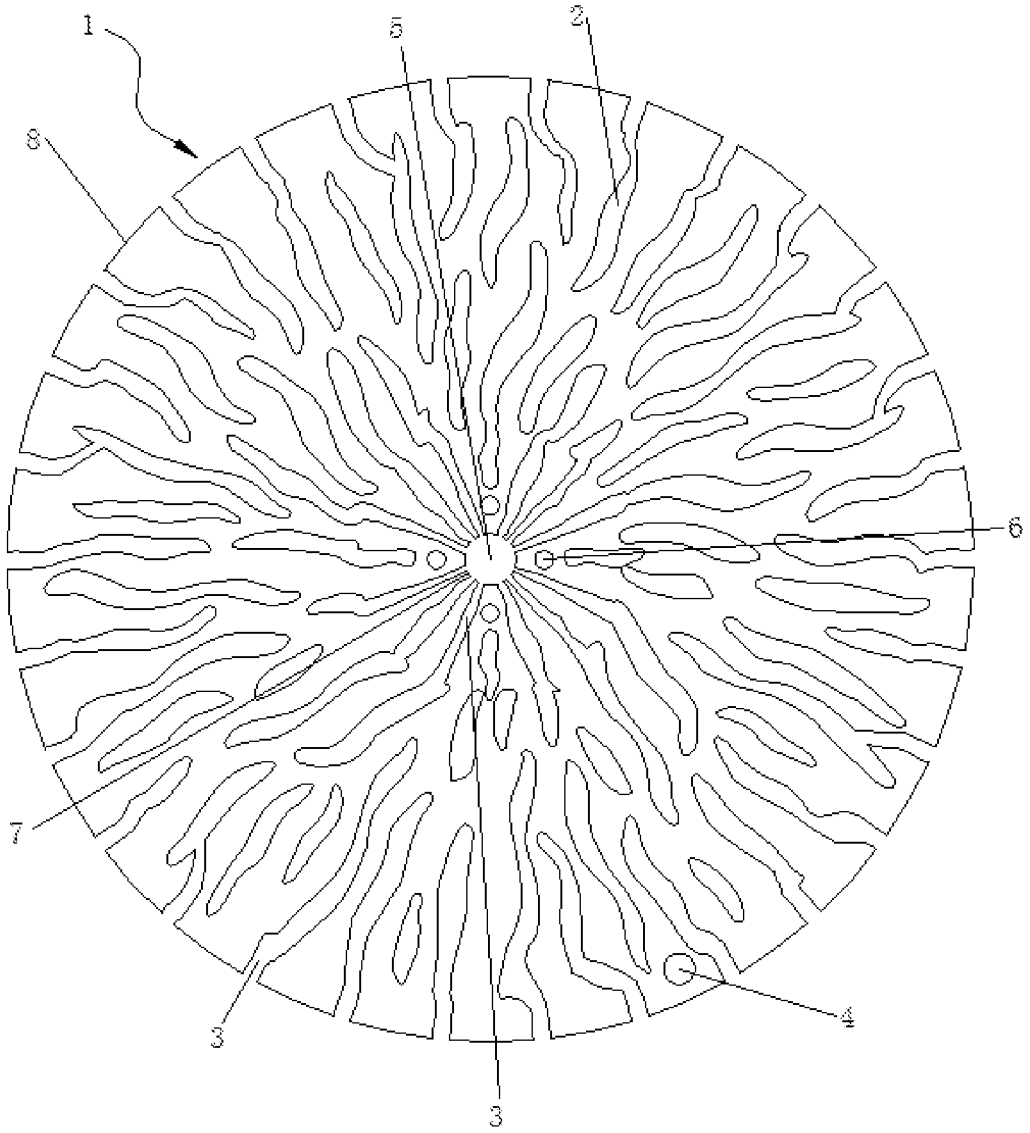
FIG. 2 is a schematic structural view of a high-temperature deformation resistant effect disk according to an embodiment of the present invention.
Figure 3:
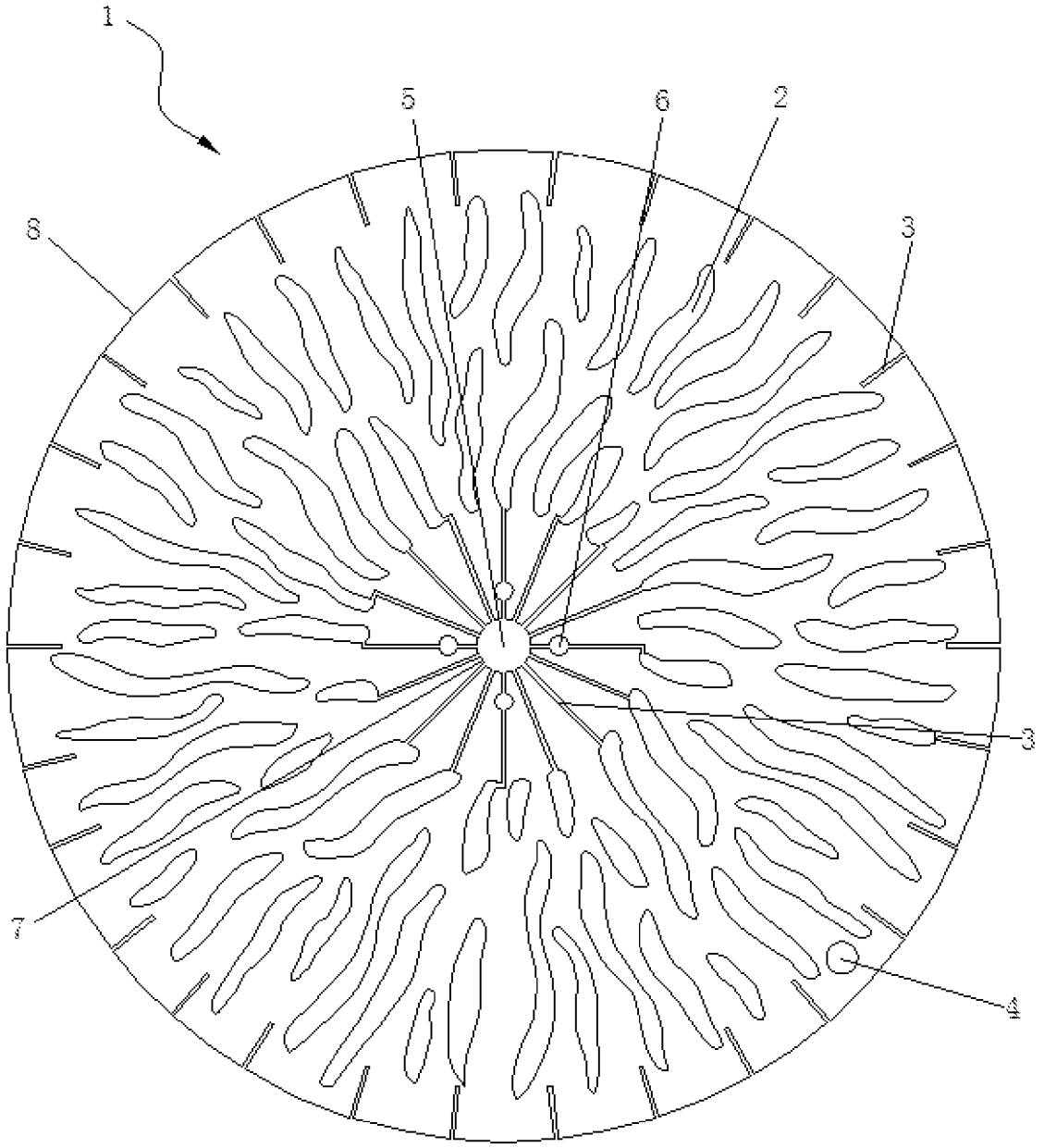
FIG. 3 is a schematic structural view of a high-temperature deformation resistant effect disk according to another embodiment of the present invention.

According to an embodiment, as shown in FIGS. 2 and 3, the disk body 1 has a central pivot hole 5, the outer periphery 8 of the disk body 1 is provided with a plurality of notches 3, and the inner periphery 7 where the central pivot hole 5 is formed is also provided with a plurality of notches 3. The notches 3 at the outer periphery 8 and the inner periphery 7 work together to avoid overall deformation of the disk body 1.

Figure 4:
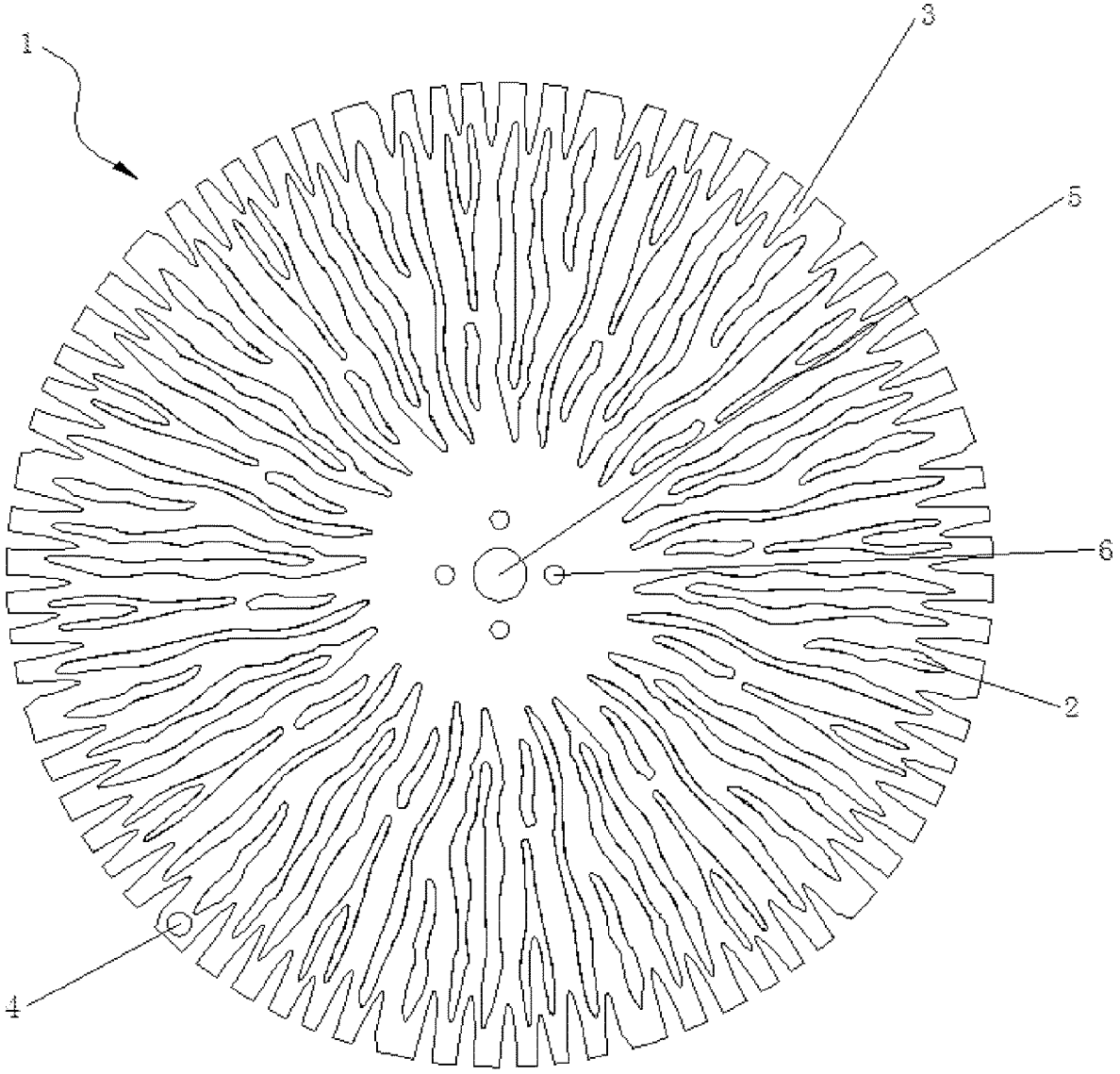
FIG. 4 is a schematic structural view of a high-temperature deformation resistant effect disk according to another embodiment of the present invention.
Figure 5:
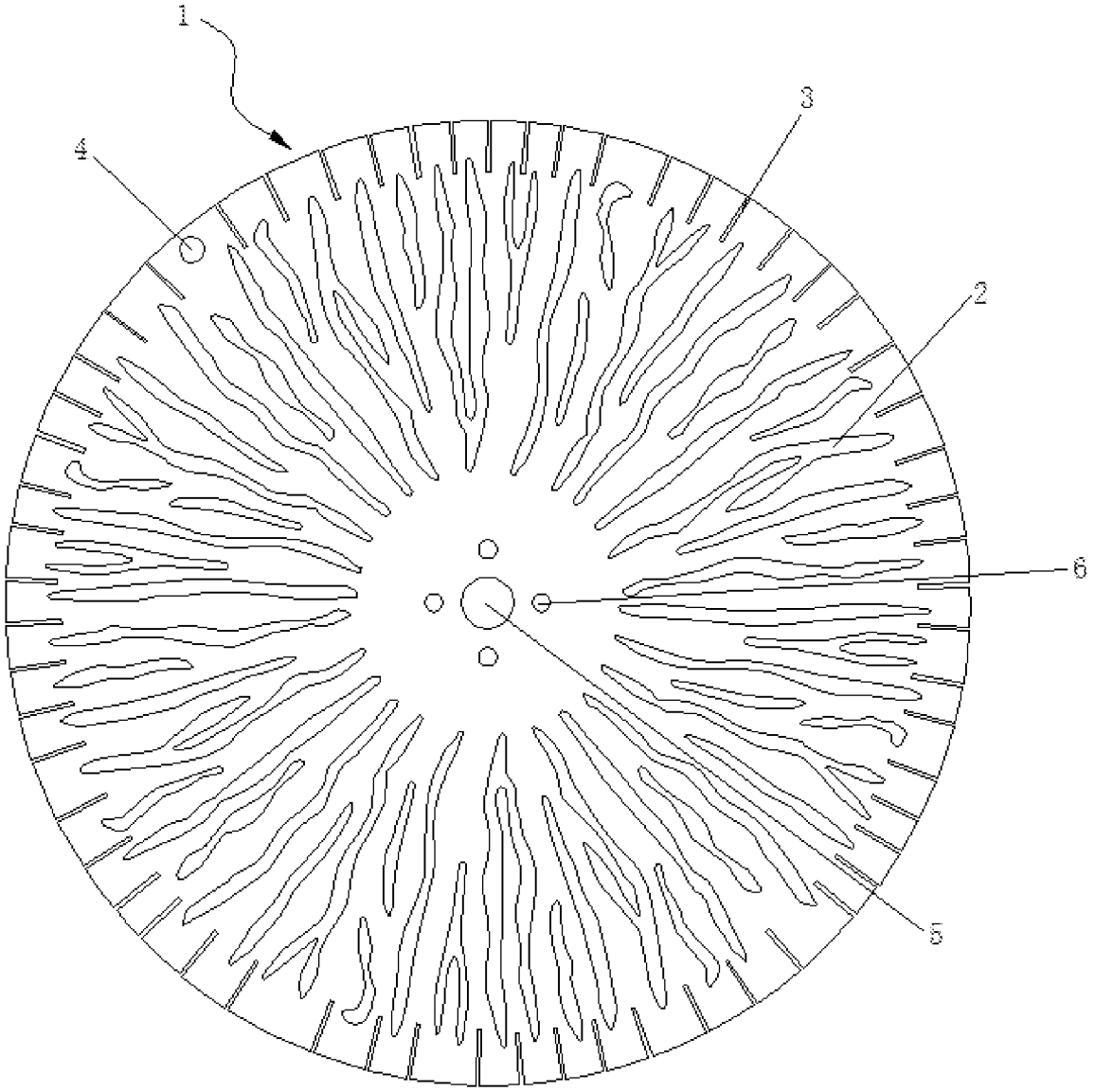
FIG. 5 is a schematic structural view of a high-temperature deformation resistant effect disk according to another embodiment of the present invention.
Figure 6:
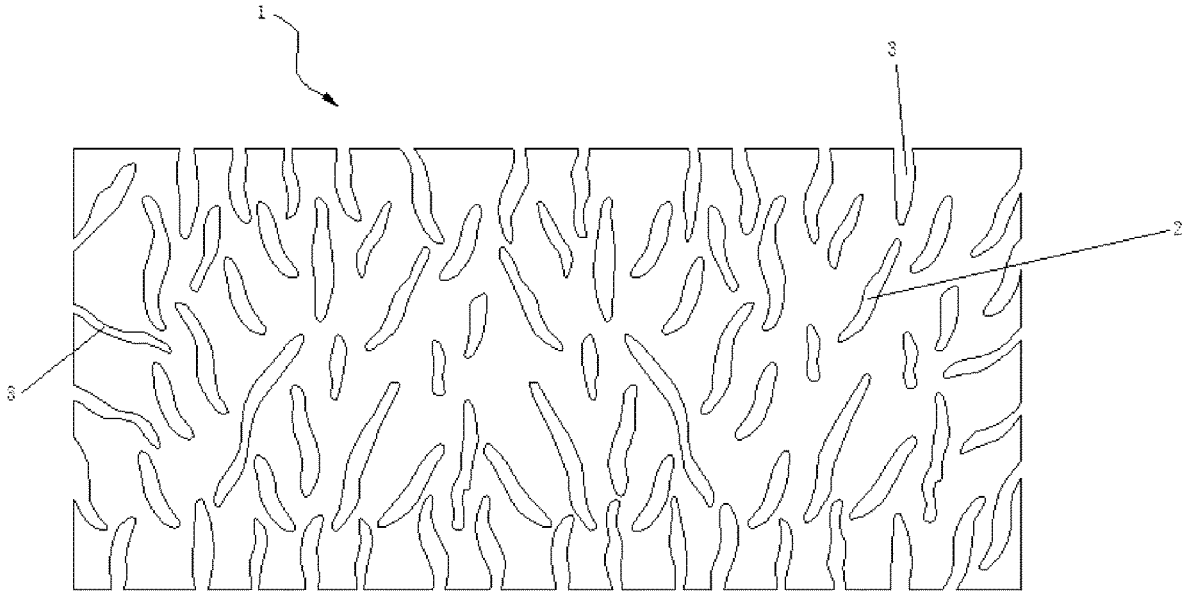
FIG. 6 is a schematic structural view of a high-temperature deformation resistant effect disk according to another a fifth embodiment of the present invention.

According to another embodiment, as shown in FIGS. 4 to 5, the disk body 1 has a central pivot hole 5, and a plurality of notches 3 is only provided on the outer periphery 8, while the inner periphery 7 avoids thermal deformation by other means, such as increasing a thickness, changing material and improving heat dissipation. Alternatively, as shown in FIG. 6, no central pivot hole 5 is provided in a center of the disk body 1, and a plurality of notches 3 are only provided on the outer periphery 8 of the disk body 1.

Figure 7:
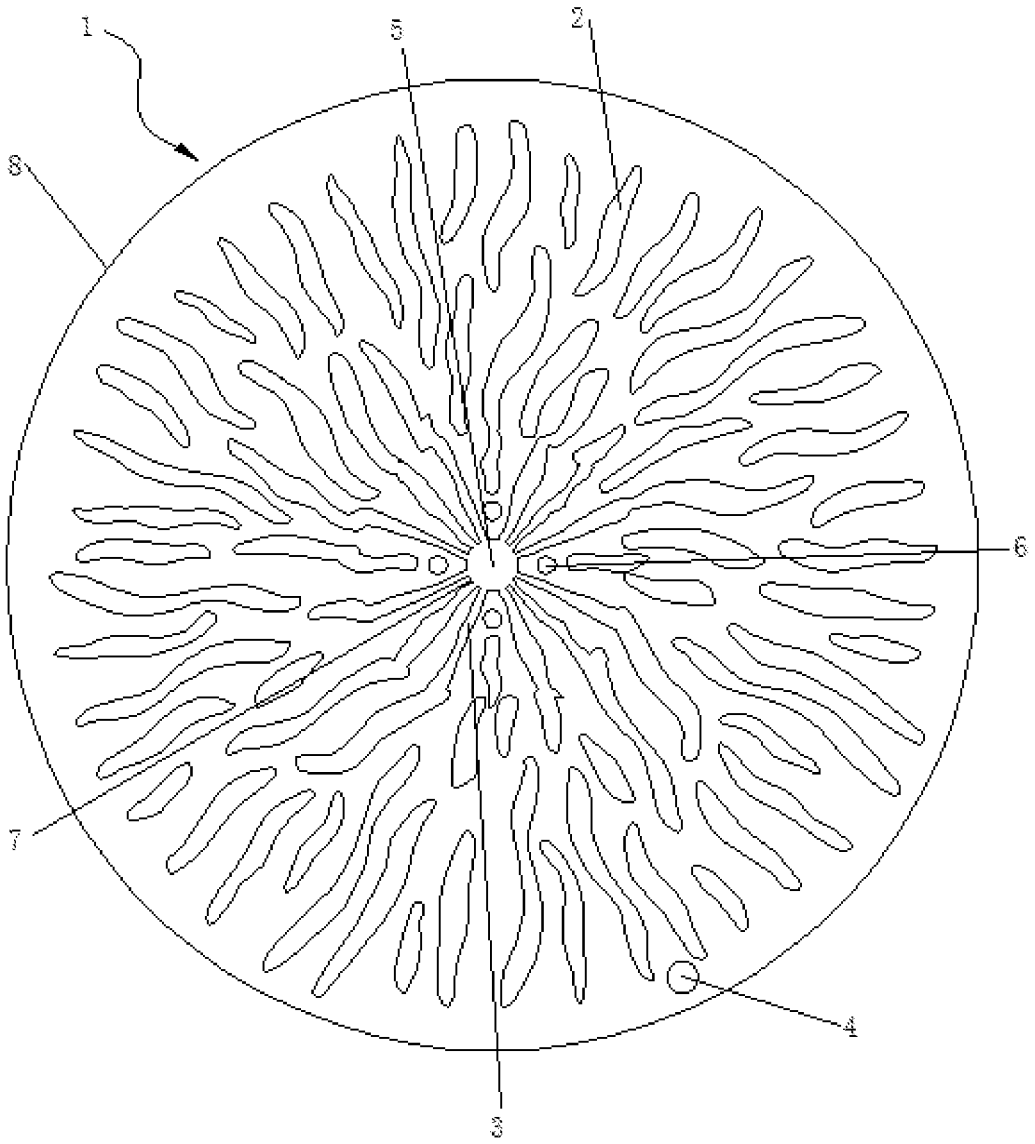
FIG. 7 is a schematic structural view of a high-temperature deformation resistant effect disk according to another embodiment of the present invention.
Figure 8:
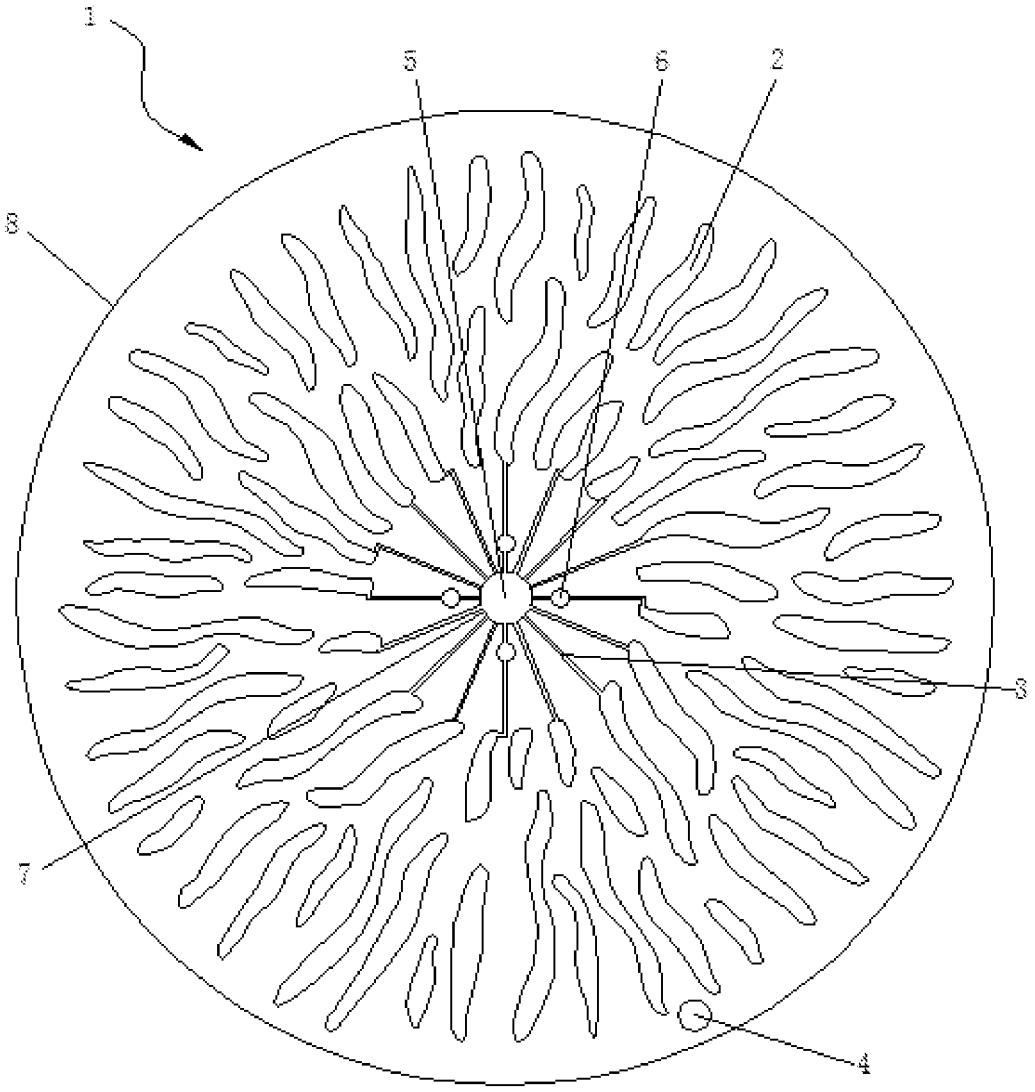
FIG. 8 is a schematic structural view of a high-temperature deformation resistant effect disk according to another embodiment of the present invention.

According to further another embodiment, as shown in FIGS. 7 and 8, the disk body 1 has a central pivot hole 5, and a plurality of notches 3 is only provided on the inner periphery 7 where the central pivot hole 5 is formed, while no notch is provided on the outer periphery 8, so that positions close to the center of the disk body 1 are prevented from thermal deformation. The outer periphery 8 of the disk body 1 can avoid thermal deformation by other means, such as increasing a thickness, changing material and improving heat dissipation.

According to the high-temperature deformation resistant effect disk, notches 3 are provided on the outer periphery 8 and/or inner periphery 7 of the disk body 1 to absorb strain force generated by thermal expansion of effect regions used to provide the hollow holes 2 on the disk body 1, so that the disk body 1 can return to an original shape after cooling without generating deformation and affecting generated pattern shapes, and the effect disk also may not be in contact with other elements in a process of rotation or translation.

Figure 9:
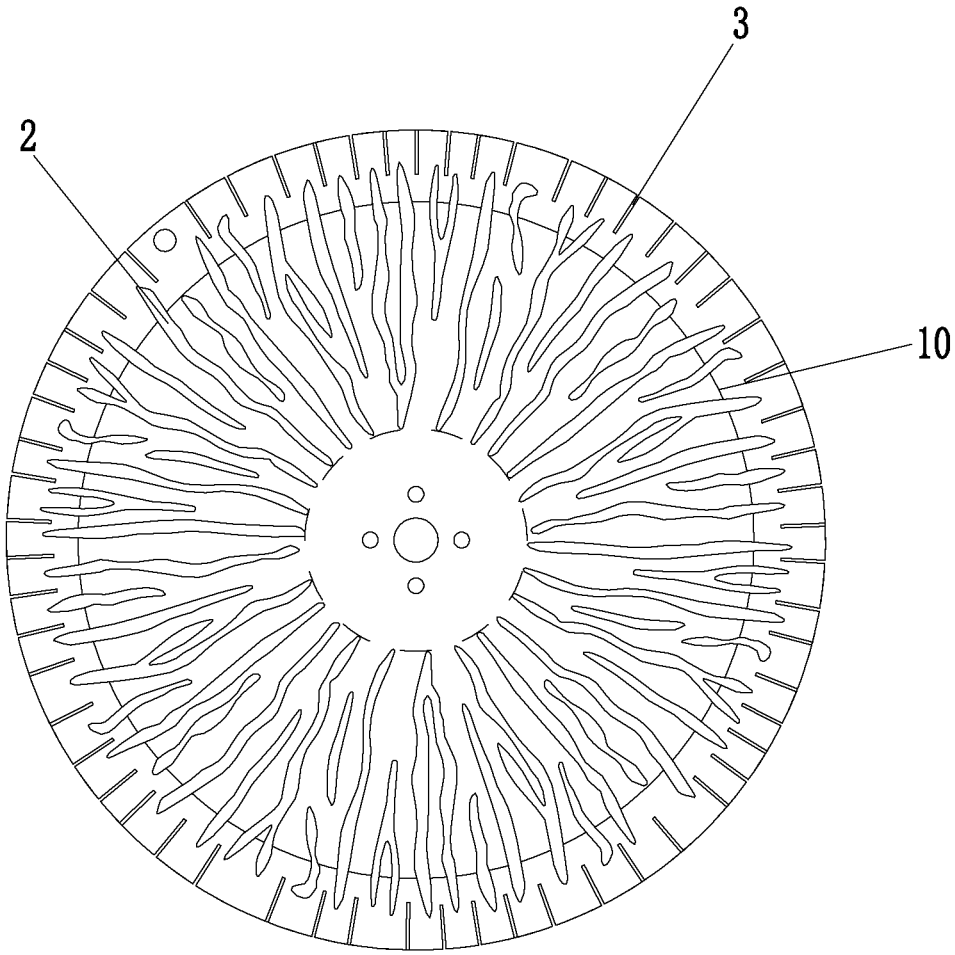
FIG. 9 is a schematic structural view of a high-temperature deformation resistant effect disk, which shows a discontinuous annular ring.

Preferably, as shown in FIG. 9, in an area defined by the notches 3 and the hollow holes 2 of the disk body 1 at one end away from each other, an annular ring 10 similar to an outline of the outer periphery 8 is formed by taking a center of the disk body 1 as a center, and the annular ring 10 is a discontinuous ring. Therefore, all the stress in the area defined by the notches 3 and the hollow holes 2 at one end away from each other can be fully released, and the deformation of the disk body 1 caused by the fact that the heat-induced stress cannot be released is avoided.

When the disk body 1 has a central pivot hole 5 and is only provided with the notches 3 on the outer periphery 8, referring to FIG. 9, the above-defined area is from the innermost side of the hollow holes 2 in broken line to the outermost side of the disk body 1. When the disk body 1 has a central pivot hole 5 and is only provided with the notches 3 on the inner periphery 7, the defined area is from the outermost side of the hollow holes 2 to the innermost side of the disk body 1. When the disk body 1 has a central pivot hole 5, and is provided with the notches 3 on both the inner periphery 7 and the outer periphery 8, the defined area is the entire disk body 1. When the disk body 1 has no central pivot hole 5 and is provided with the notches 3 on the outer periphery 8, the defined area is also the entire disk body 1.

Preferably, the disk body 1 is circular shown in FIGS. 2 and 3 or rectangular shown in FIG. 6. A circular shape is the most commonly used shape of the effect disk. Generally, when the effect disk 1 is circular, the effect disk realizes dynamic pattern effects in the form of rotation. A rectangular effect disk 1 is not commonly used since it usually realizes dynamic pattern effects in a moving manner during use, which requires larger spatial locations. Regardless of whether the disk body 1 is circular or rectangular, the notches provided thereon can release the strain force of the disk body 1 after being heated. The same effect can be achieved when the disk body 1 is in other shapes. A circular or rectangular shape is only a preferred embodiment according to the present invention.

When the disk body 1 is circular, in an area defined by the notches 3 and the hollow holes 2 of the disk body 1 at one end away from each other, an annular ring similar to the outline of the outer periphery 8 formed by taking a center of the disk body 1 as a center thereof is a discontinuous ring, which means that in the area defined by the notches 3 and the hollow holes 2 of the disk body 1 at one end away from each other, a collection of projections of all the hollow holes 2 and the notches 3 in the radial direction can completely cover radius lines of the disk body 1 in the refined area so as to form the discontinuous annular ring similar to the outline of the outer periphery 8.

Preferably, as shown in FIGS. 2 to 5, and FIGS. 6 to 8, with the center of the disk body 1 as a center, both the hollow holes 2 and the notches 3 are provided radially in a radial direction or in a circumferential direction of the disk body 1. The extending direction of the notches 3 is consistent with that of the hollow holes 2, which can produce light effects together with richer effects. In other embodiments, the extending directions of the hollow holes 2 and the notches 3 may not be consistent.

The function of each hollow hole 2 is to shape the light path, and the hollow hole 2 can produce patterns during the movement, such as flames, white clouds, flowing water and starry sky. Therefore, the arrangement of the hollow holes 2 can certainly be specifically designed according to needs without limitation. It is well known to those skilled in the art that the radial arrangement or the circumferential arrangement is only a preferred solution of this embodiment. In other embodiments, the extending direction of the hollow holes 2 can be in other manners. For example, as shown in FIG. 6, the extending direction of the hollow holes 2 is substantially parallel to a width direction of the rectangular disk body 1.

The function of the notch 3 is to release strain force, so that special requirements are not needed for a specific extending direction as long as the strain force generated by the thermal deformation of the disk body 1 can be released. In this embodiment, the notches 3 are required to be radially provided in a radial direction or in a circumferential direction of the disk body 1, which is only for cooperation between the notches and the hollow holes 2 to produces light effects. In other embodiments, the notches 3 can also extend in other directions without affecting strain-release effects thereof.

Preferably, a width range of the notch 3 is 0.2 mm to 2.0 mm, and a width of the notch 3 in these embodiments is 0.5 mm, which leaves a space for the disk body 1 with heat-induced deformation and avoids irreversible deformation.

Preferably, the notches 3 on the outer periphery 8 are at least partially provided at equal intervals, and/or the notches 3 on the inner periphery 7 are at least partially provided at equal intervals, so that the strain force of the disk body 1 is evenly released as much as possible in order to prevent warp caused by excessive absorption of local strain force. However, an interval between some adjacent notches 3 may be a little larger.

Preferably, when a plurality of notches 3 are provided on the outer periphery 8 of the disk body 1, a central angle between any adjacent notches 3 is ≤15° with the center of the disk body 1 taken as the center. That is, the number of the notches 3 on the outer periphery 8 is greater than or equal to 24. Due to the fact that the width of the disk body 1 is approximately between 8 cm and 18 cm, such arrangement ensures that the strain force at each position of the disk body 1 close to the outer periphery 8 can be fully released, and prevents positions between adjacent notches 3 corresponding to an excessively large central angle of the outer periphery 8 on the disk body 1 from being heated and deformed, thereby ensuring a heat and deformation resistant performance of the entire disk body.

More preferably, when a plurality of notches 3 are provided on the outer periphery 8 of the disk body 1, a central angle between any adjacent notches 3 is ≤12° with the center of the disk body 1 taken as the center, that is, the number of the notches 3 on the outer periphery 8 is greater than or equal to 30 to better release the strain force.

Preferably, when the inner periphery 7 of the disk body 1 where the central pivot hole 5 is formed is provided with a plurality of notches 3, a central angle between any adjacent notches 3 is ≤45° with the center of the disk body 1 taken as the center. That is, the number of the notches 3 on the inner periphery 7 should be greater than or equal to 8. Since the width of the central pivot hole 5 is between 0.5 cm and 1.5 cm, the circumference of the inner periphery 7 is small, so that a corresponding central angle between adjacent notches 3 can be appropriately enlarged. However, it should be ensured that a central angle between any adjacent notches is ≤45° when a distance between adjacent notches 3 does not increase much, thereby ensuring that the strain force at each position of the disk body 1 close to the inner periphery 7 can be fully released, preventing positions between adjacent notches 3 corresponding to an excessively large central angle of the inner periphery 7 on the disk body 1 from being heated and deformed, and ensuring a heat and deformation resistant performance of the entire disk body 1.

More preferably, when a plurality of notches 3 are provided on the inner periphery 7 of the disk body 1 used to form the central pivot hole 5, a central angle between any adjacent notches 3 is ≤15° with the center of the disk body 1 taken as the center.

A communication relationship between the notch 3 and the hollow hole 2 has two solutions.

In a first solution, the notch 3 does not communicate with the hollow hole 2. Preferably, as shown in FIGS. 4 to 6, when the notch 3 does not communicate with the hollow hole 2, the notch 3 extends into an area between two adjacent hollow holes 2. With this arrangement, distribution of the notch 3 and the hollow hole 2 is more reasonable, and the heat and deformation resistant performance of the effect disk is further improved. In other embodiments, the notch 3 can also just touch the effect region provided with the hollow hole 2 while not enter between two adjacent hollow holes 2, which can also function to release the stress to some certain extent, such as partial notches on the outer periphery 8 in FIG. 3.

In a second solution, the notch 3 communicates with the hollow hole 2. Preferably, the notch 3 extends into an area between two adjacent hollow holes 2 and communicates with at least one of the hollow holes 2, such as partial notches 3 on the outer periphery 8 in FIG. 2; or the notch 3 does not extend into between two adjacent hollow holes 2, but directly communicates with an end of the hollow holes 2, such as partial notches 3 on the inner periphery 7 in FIGS. 2, 3, 7 and 8.

It should be noted that, regardless of whether the notch 3 communicates with the hollow hole 2, the notch 3 can release the strain force to avoid heat-induced irreversible deformation of the disk body 1, which is well known to those skilled in the art.

Preferably, in a direction close to the center of the disk body 1, a width of the notch 3 gradually decreases as shown in FIGS. 2, 4 and 7, or remains constant as shown in FIGS. 3, 5 and 8. Since the closer the disk body 1 is to the center, the smaller the area is, it is more appropriate to gradually decrease the width of the notch 3 in the direction close to the center of the disk body 1, or the width of the notch 3 remains constant at a small value as long as side walls forming the notch 3 are ensured to be not in contact with each other after the disk body 1 releases the strain force.

Preferably, one surface of the disk body 1 is a black surface or a frosted surface, and the other corresponding surface is a polished surface. The black surface can be formed by paint spraying, and the frosted surface can be formed by roughening. During actual use, the surface which is the black or frosted surface of the disk body 1 is provided far away from a light source so as to avoid that a reflected ray causes an emergent ray to be mixed with parasitic light; the polished surface of the disk body is provided directly facing the light source, and the polished surface can prevent the effect disk from absorbing heat.

Preferably, the disk body 1 is provided with a plurality of screw mounting holes 6 around the central pivot hole 5, and the central pivot hole 5 and the screw mounting holes 6 are used to fix the effect disk on a rotating shaft.

Preferably, the outer periphery 8 of the disk body 1 is provided with positioning holes 4 used to mount magnets, and the disk body 1 can position the rotation thereof via the magnets.

Preferably, the disk body 1 is made of aluminum material.

Figure 10:
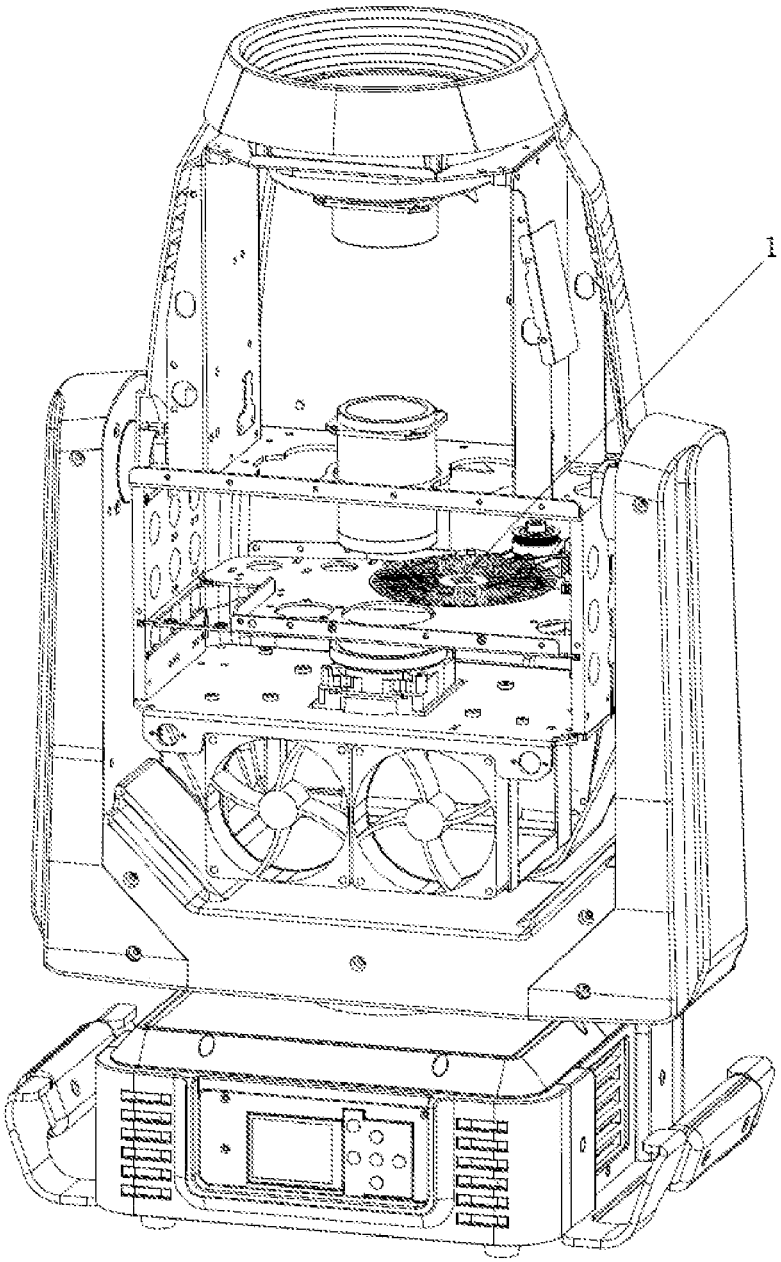
FIG. 10 is a perspective view of a stage light with a high-temperature deformation resistant effect disk.

In FIG. 10, a stage light is provided, including a light source used to generate a light path and any of the above-mentioned effect disks, in which the light source and the effect disk are both located in a light head.

Preferably, the light head is pivotally connected to a support arm, and the support arm is pivotally connected to a base.

Preferably, referring to FIG. 9, in an area defined by the notches 3 and the hollow holes 2 of the disk body 1 at one end away from each other, an annular ring 10 similar to an outline of the outer periphery 8 is formed by taking a center of the disk body 1 as a center, and the annular ring 10 is a discontinuous ring.

Preferably, the stage light also includes a rotation driving mechanism used to drive the effect disk to rotate and/or a movement driving mechanism used to drive the effect disk to move, both of which are not required at the same time as long as one of the both is provided. The movement driving mechanism drives the effect disk to cut in and out of the light path, so as to determine whether the light path is affected. A manner in which the movement driving mechanism drives the effect disk to cut in and out of the light path can be translation or swing, that is, revolution.

When the disk body 1 is circular, the rotation driving mechanism and the movement driving mechanism are generally required at the same time, in which the rotation driving mechanism is used to drive rotation so as to produce dynamic effects while the movement driving mechanism is used for movement driving so as to cut in and out of the light path. When the disk body 1 is rectangular, only the movement driving mechanism is generally needed and is used for movement driving so as to produce dynamic effects and cut in and out of the light path.

Obviously, the above embodiments of the present invention are merely examples for clear illustration of the present invention, and are not intended to limit the implementations of the present invention. For those skilled in the art, modifications or changes in other forms can also be made on the basis of the above description. It is unnecessary and impossible to exhaust all implementations herein. Any modification, equivalent substitution, improvement or the like within the spirit and principle of the invention should be included in the scope of the claims of the present invention.

The invention claimed is:

1. A high-temperature deformation resistant effect disk, comprising:

a disk body; and a plurality of hollow holes provided on the disk body, which are configured to generate light effects, wherein an outer periphery of the disk body is provided with a plurality of notches which are configured to release strain force generated by thermal expansion of effect regions where the plurality of hollow holes are arranged, and wherein in an area defined between an end of the plurality of hollow holes which is nearest from a center of the disk body and an end of the plurality of notches which is farthest from the center of the disk body, a circle with discontinuous arcs is formed when taking the center of the disk body as a center of the circle and passing through any point in the area.

2. The high-temperature deformation resistant effect disk according to claim 1, wherein an inner periphery of the disk body where a central pivot hole is formed is further provided with a plurality of notches.

3. The high-temperature deformation resistant effect disk according to claim 1, wherein the disk body is circular or rectangular.

4. The high-temperature deformation resistant effect disk according to claim 1, wherein with the center of the disk body as a center, both the plurality of hollow holes and the plurality of notches are provided radially in a radial direction or in a circumferential direction of the disk body.

5. The high-temperature deformation resistant effect disk according to claim 1, wherein the plurality of notches on the outer periphery are at least partially provided at equal intervals.

6. The high-temperature deformation resistant effect disk according to claim 1, wherein a central angle between any adjacent notches is less than or equal to 15° with the center of the disk body taken as a center.

7. The high-temperature deformation resistant effect disk according to claim 1, wherein at least one of the plurality of notches is configured to be not communicated with the plurality of hollow holes and extend into an area between two adjacent hollow holes.

8. The high-temperature deformation resistant effect disk according to claim 1, wherein at least one of the plurality of notches is configured to extend into an area between two adjacent hollow holes and is communicated with at least one of two adjacent hollow holes, or wherein at least one of the plurality of notches is correspondingly communicated with the plurality of hollow holes at one end of each hollow hole.

9. The high-temperature deformation resistant effect disk according to claim 1, wherein a width of each notch gradually decreases or remains constant in a direction from the outer periphery to the center of the disk body.

10. The high-temperature deformation resistant effect disk according to claim 1, wherein one surface of the disk body is a black surface or a frosted surface, and the other corresponding surface is a polished surface.

11. A stage light, comprising:

a light source used to generate a light path, the light source being located in a light head; and an effect disk configured to generate light effects, which comprises a disk body and a plurality of hollow holes provided on the disk body, the effect disk being located in the light head, wherein an outer periphery of the disk body is provided with a plurality of notches which are configured to release strain force generated by thermal expansion of effect regions where the plurality of hollow holes are arranged, and in an area defined between an end of the plurality of hollow holes which is nearest from a center of the disk body and an end of the plurality of notches which is farthest from the center of the disk body, a circle with discontinuous arcs is formed when taking the center of the disk body as a center of the circle and passing through any point in the area, or wherein an inner periphery of the disk body where a central pivot hole is formed is further provided with a plurality of notches which are configured to release strain force generated by thermal expansion of effect regions where the plurality of hollow holes are arranged.

12. The stage light according to claim 11, wherein at least one of the plurality of notches is configured to be not communicated with the plurality of hollow holes and extend into an area between two adjacent hollow holes, or wherein at least one of the plurality of notches is communicated with the plurality of hollow holes.

13. The stage light according to claim 11, further comprising:

a rotation driving mechanism configured to drive the effect disk to rotate; and/or a movement driving mechanism configured to drive the effect disk to move.

14. A high-temperature deformation resistant effect disk, comprising:

a disk body; and a plurality of hollow holes provided on the disk body, which are configured to generate light effects, wherein an inner periphery of the disk body where a central pivot hole is formed is provided with a plurality of notches which are configured to release strain force generated by thermal expansion of effect regions where the plurality of hollow holes are arranged.

15. The high-temperature deformation resistant effect disk according to claim 14, wherein in an area defined between an end of the plurality of hollow holes which is farthest from a center of the disk body and an end of the plurality of notches which is nearest from the center of the disk body, a circle with discontinuous arcs is formed when taking the center of the disk body as a center of the circle and passing through any point in the area.

16. The high-temperature deformation resistant effect disk according to claim 14, wherein at least one of the plurality of notches is configured to be not communicated with the plurality of hollow holes and extend into an area between two adjacent hollow holes.

17. The high-temperature deformation resistant effect disk according to claim 14, wherein at least one of the plurality of notches is configured to extend into an area between two adjacent hollow holes and is communicated with at least one of the two adjacent hollow holes, or wherein at least one of the plurality of notches is correspondingly communicated with the plurality of hollow holes at one end of each hollow hole.

18. The high-temperature deformation resistant effect disk according to claim 14, wherein a central angle between any adjacent notches is less than or equal to 45° with a center of the disk body taken as a center.

19. The high-temperature deformation resistant effect disk according to claim 14, wherein a width of each notch gradually decreases or remains constant in a direction from the outer periphery to the center of the disk body.

20. The high-temperature deformation resistant effect disk according to claim 14, wherein an outer periphery of the disk body is further provided with a plurality of notches.

* * * * *